US006358007B1

(12) United States Patent
Castle

(10) Patent No.: US 6,358,007 B1
(45) Date of Patent: Mar. 19, 2002

(54) UNIVERSAL CONSTANT SPEED VARIABLE PITCH BOAT PROPELLER SYSTEM

(76) Inventor: Henry A. Castle, 0861 Odin Dr., Silt, CO (US) 81652

( * ) Notice: Subject to any disclaimer, the term of this patent is extended or adjusted under 35 U.S.C. 154(b) by 0 days.

(21) Appl. No.: 09/494,227

(22) Filed: Jan. 27, 2000

Related U.S. Application Data

(60) Provisional application No. 60/117,605, filed on Jan. 28, 1999.

(51) Int. Cl.[7] ..... B63H 3/00

(52) U.S. Cl. ..... 416/48; 416/154; 416/155; 416/157 R; 416/244 B

(58) Field of Search ..... 416/48, 154, 155, 416/156, 157 R, 244 B

(56) References Cited

U.S. PATENT DOCUMENTS 2,958,381 A * 11/1960 Stevens et al. ..... 416/48
3,501,251 A * 3/1970 Haglund et al. ..... 416/48
4,599,043 A * 7/1986 Muller ..... 416/162
4,643,643 A * 2/1987 Otto ..... 416/154
4,781,533 A * 11/1988 Andersson ..... 416/157 R
5,415,523 A * 5/1995 Muller ..... 416/35

* cited by examiner

*Primary Examiner*—Edward K. Look
*Assistant Examiner*—Ninh Nguyen
(74) *Attorney, Agent, or Firm*—Ramon L. Pizarro; Edwin H. Crabtree

(57) ABSTRACT

An adjustable pitch boat propeller system adapted for mounting on a drive shaft of a marine drive unit of a boat. The propeller includes an hub that has been adapted for mounting over the drive shaft of the boat, the hub having an external surface and internal annular surface. An annular piston is mounted against the internal annular surface and connected to a plurality of blades which are pivotally connected to the external surface of the hub by way of a linkage that allows pivoting the plurality of blades in response to movements of the annular piston.

20 Claims, 5 Drawing Sheets

20
40
40
18
38

10
14
20
24
12
16

UNIVERSAL CONSTANT SPEED VARIABLE PITCH BOAT PROPELLER SYSTEM

REFERENCE TO RELATED APPLICATIONS

This application is a continuation of, and claims the benefit of, my provisional application having Ser. No. 60/117,605, filed Jan. 28, 1999, now abandoned.

BACKGROUND OF THE INVENTION (a) Field of the Invention

This invention generally relates to a system for controlling the pitch of boat propeller blades. More particularly, but not by way of limitation, to a variable pitch propeller, to a system that allows the user of a propeller driven boat to vary the pitch on the propeller to vary the amount of advancement of the screw through the water, while maintaining constant propeller speed (revolutions per minute).

(b) Background Art

The advantages of variable pitch propellers have long been recognized, particularly in applications dealing with watercraft. An important advantage that is gained from adjusting the pitch of the propeller blades is that the more effective use of the engine's horsepower can be made. More specifically, to initiate motion of the boat, a low pitch angle is desired to allow the engine to develop the necessary revolutions per minute (RPMS) and power output to provide the needed thrust and acceleration to accelerate the boat. Once a desired speed is reached, the angle of the blades may then be adjusted to provide the needed thrust to maintain the speed of the boat while allowing the blades to self adjust to maintaint the optimal pitch angle for a given boat speed.

An important, highly desired, characteristic of a propeller system is that it provide only the amount of thrust needed to maintain the desired boat speed. Thus, while accelerating the propeller system would provide a great deal of thrust, and while cruising at a constant speed the propeller would provide the power needed to overcome the losses associated with friction or drag. Additionally, at higher speeds the advancement of the boat per turn of the screw is greater. Therefore, it follows that it is desirable to increase the pitch of the blades at higher speeds to accommodate for the greater distance advanced with each turn. Thus, it is desired to reduce the engine RPM when possible to do so while maintaining boat velocity, and thus optimizing fuel economy for a given boat velocity.

Still further, since the losses at a constant speed are likely to stay constant, it would appear that it is desirable to provide a propeller system that is sensitive to the amount of thrust needed, and that would adjust the amount of pitch on the propeller in proportion to the required thrust.

Another desired feature that is needed in variable pitch propellers is that the mechanism used to adjust the pitch of the blades should adjust the pitch angle of each blade in a manner that results in all blades providing substantially the same helix or screw angle. Maintaining the same helix or screw angle on each blade allows even distribution of the thrust load on each of the blades.

Additionally, it is highly desirable that the mechanism used to pivot the blades be simple, reliable, and unobtrusive. The expense associated with the manufacture and maintenance of complicated variable pitch boat propeller mechanisms has limited the use of these propellers to applications where performance carries a higher priority than cost. This has meant the use of these propellers has been limited to military craft or similar high performance water craft.

Yet another problem associated with the adoption of propeller systems which use variable pitch propellers is that these systems will typically require that the user discard the entire drive system of boat, including drive shafts and exhaust systems used with the existing motor. This is a serious limitation that has prevented wide spread use of variable pitch propellers because the increase in performance provided by the ability to vary the pitch has yet to be provided in a cost effective manner that would justify the replacement of an entire drive system on an existing boat drive mechanism.

Known examples of variable pitch propellers include the mechanism shown in U.S. Pat. No. 5,366,343 to Muller. Muller teaches a variable pitch propeller that can be mounted on the shaft of a non-variable pitch drive motor which can be modified to accommodates the mechanisms for operating this system. In other words, the existing device must accommodate an external actuator mechanism that moves the Muller propeller's blades to a desired angle. This arrangement exemplifies the problems associated with many known variable pitch systems. The external actuator increases drag and complexity of the system. Additionally, the Muller system is designed to completely detach the hydraulic actuation system from the propeller. This eliminates or greatly reduces the coupling or association of the thrust on the propeller and the pressure in the hydraulic system of the mechanism.

Similar approaches can be found in many examples of known deices. For example the systems taught in U.S. Pat. No. 4,872,811 to Cavallaro et al., U.S. Pat. No. 4,822,243 to Poucher, U.S. Pat. No. 4,563,940 to Wuhrer, U.S. Pat. No. 4,952,083 to Kuehl, U.S. Pat. No. 4,907,992 to Cavallaro et al., U.S. Pat. No. 4,880,402 to Muller, U.S. Pat. No. 4,744,727 to Muller, U.S. Pat. No. 5,836,743 to Carvalho et al.

Thus, a review of known devices reveals that there remains a need for a simple variable pitch mechanism for use with boat propeller systems.

Importantly, there remains a need for a variable pitch boat propeller system that is sensitive or responsive to the amount of load needed for maintaining the speed of the boat, and thus a system that automatically adjusts the pitch of the propeller to increase the thrust as needed to maintain a constant boat speed.

There remains a need for a simple adjustable pitch boat propeller system that can be used with a commercially available marine drive unit which was originally designed for accepting a fixed blade propeller.

Still further, there remains a need for a variable pitch propeller system that is robust, and uses few moving parts.

SUMMARY

It has been discovered that the problems left unanswered by known art can be solved by providing an adjustable pitch propeller system which includes:

an annular hub;

an annular piston that has been adapted for moving within the annular hub; and at least two blades which are pivotally mounted on the hub and connected to the annular piston, so that movements of the annular piston within the annular hub produce simultaneous movements of the blades.

According to a highly preferred embodiment of the invention, each of the blades is connected to the annular piston by way of a link or connecting rod. The link is pivotally connected to the annular piston at one end and pivotally connected to a blade at the other end. According to a highly preferred example of the invention, it is contemplated that the connection between each of the blades and the link will include a blade angle adjustment plug. The adjustment plug will allow the user to change the effective length of the linkage to vary the starting pitch of each of the blades.

Additionally, it is important to note that it has been discovered that the annular hub allows mounting of the disclosed system on the propeller shaft of a marine drive unit with little or no modification of the output shaft of the motor. According to a highly preferred embodiment of the invention the annular piston is powered or moved in one direction by the exertion of hydraulic pressure from a governor mechanism. The governor mechanism allows the user to set the hydraulic pressure against the annular piston at a desired level. Because the piston is connected to the blades by way of the linkage, the force of the water against the moving blade will transmit the resulting thrust related force against the blade on to the piston through the linkage. This thrust related force must be balanced by the hydraulic pressure imposed on the piston by way of the governor mechanism. Thus, it will be appreciated that the pitch of the blades will be determined by the linkage geometry and the hydraulic pressure against the annular piston as set by the governor. Of course, this relation between the pitch of the blades and pressure set by the governor is not applicable beyond the length of travel of the piston. Thus, if very low hydraulic pressure is applied to the piston while the propeller is turning, the force of the water against the blades will cause the blades to return to the lowest pitch position, forcing the annular piston into the hub until the bottom or end of the annular piston's travel is reached. Maximum pitch is achieved when the annular piston reaches the opposite end of the stroke travel.

Thus, it will be understood that the disclosed invention solves problems associated with known adjustable pitch boat propellers or screws by providing constant adjustment of the blade pitch in proportion to the speed, and hence water induced load, of the propeller. Accordingly, the disclosed invention will allow the user to maintain constant boat speed by adjusting the pressure provided by the governor in addition to varying engine RPM (revolutions per minute).

Still further, it will be understood that the disclosed system provides a simple, robust, mechanism that uses structure that exists on most marine drive units with little or no modification of these drive units.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figures 1, 1A, 1B, 1C:
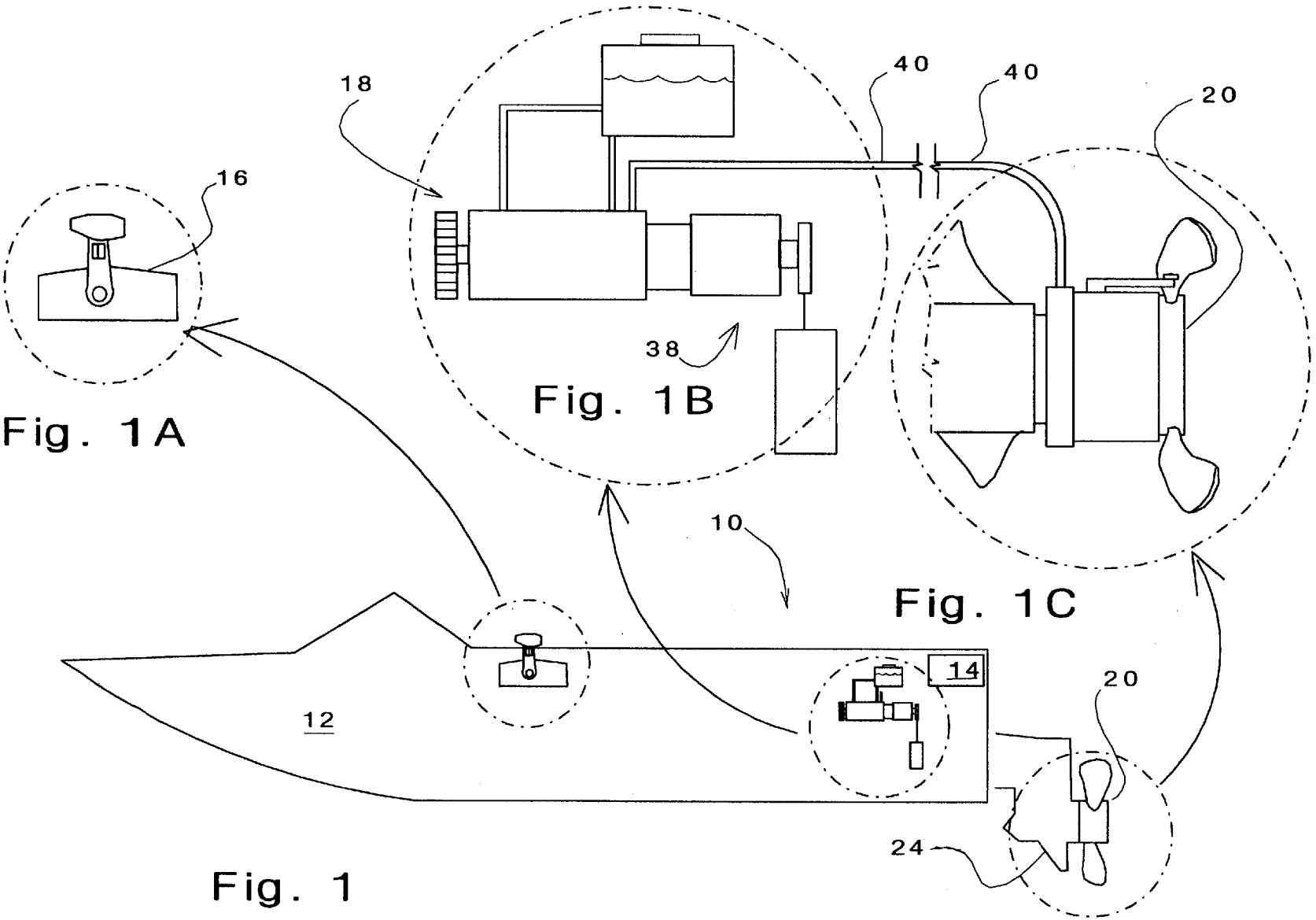
FIG. 1 is a schematic of an example of an installation using the disclosed system on a marine drive unit.
FIG. 1A is a detail of an example of a remote control unit used with the system.
FIG. 1B is a detail of an example of a governor system used to control hydraulic pressure in the disclosed system.
FIG. 1C is a schematic of the blade actuator system disclosed herein.

Turning now to FIG. 1 where a schematic of a universal constant speed, variable pitch boat propeller system 10 is shown in schematic form. The variable pitch boat propeller system 10 is shown mounted on a boat 12, which has a motor 14 marine drive unit 24. Mounted within the boat 12 is a control unit 16, shown in greater detail in FIG. 1A, a governor system 18, shown in greater detail in FIG. 1B. The governor system 18 provides hydraulic fluid and pressure for an adjustable pitch boat propeller 20 which is used with the system 10.

Figure 2:
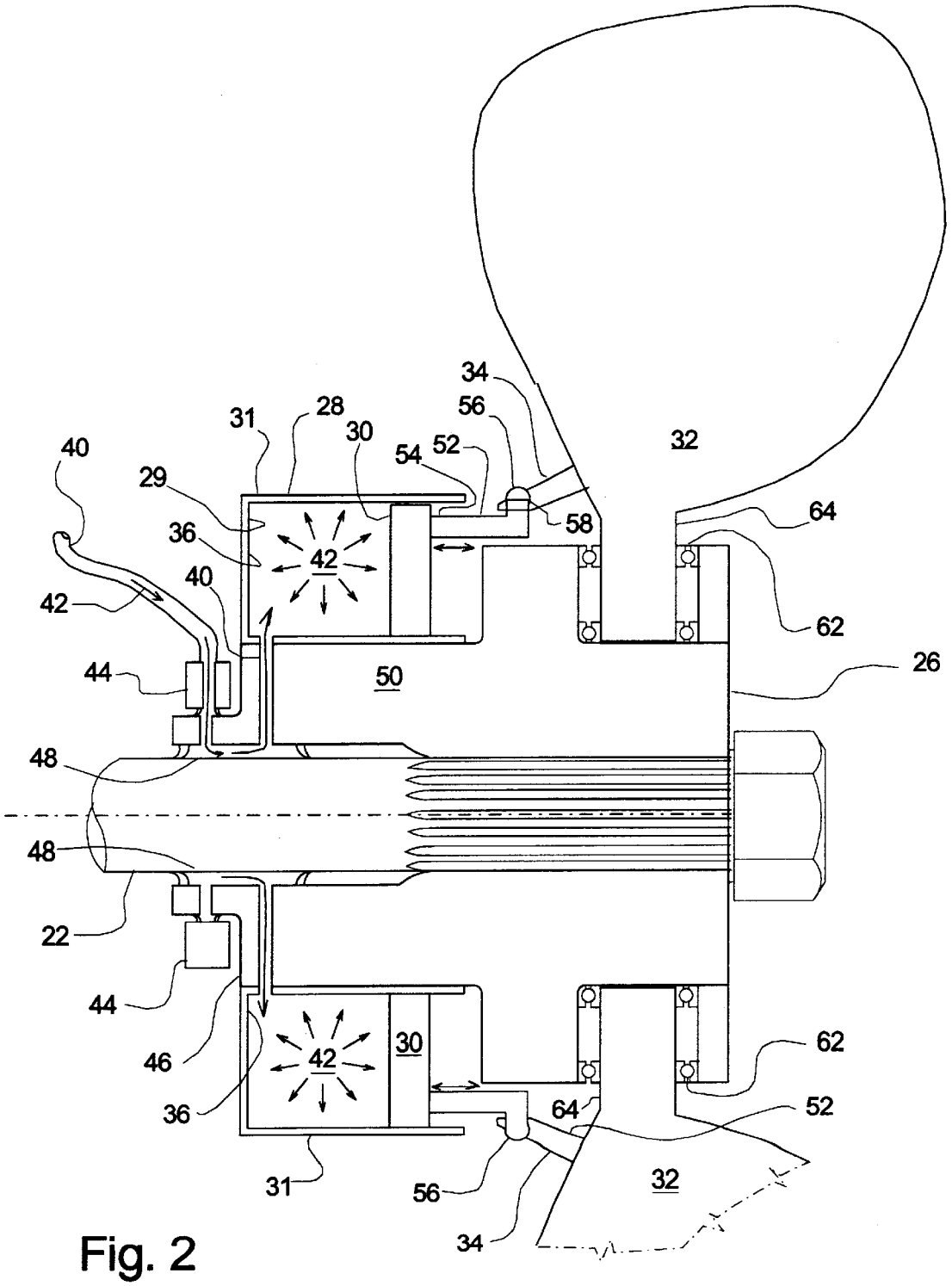
FIG. 2 is a schematic illustrating the flow path of fluid from the governor into the adjustable pitch propeller taught herein.

The adjustable pitch boat propeller 20 has been adapted for mounting on a drive shaft 22 of a marine drive unit 24. Turning now to FIG. 2, it will be understood that the propeller 20 includes a hub 26 which mounts over the drive shaft 22 of the drive unit 24 used with the boat 12. As shown, a preferred example of the hub 26 includes an external surface 28, an internal surface 29, and a piston 30 that is housed within the external surface 28 and moves along the internal surface 29 of the hub 26.

It has also been illustrated that a plurality of blades 32 are pivotally connected, or mounted, on the external surface 28 of the hub 26. All of the blades are connected to the piston 30 by way of a connecting means 34 which allow or provide pivoting the plurality of blades 32 in response to movements of the piston 30.

Thus, it will be understood that the governor system 18 provides a means for providing a desired amount of hydraulic pressure between the internal annular surface 36 of the hub 26 and the piston 30. Preferably, the governor 18 will serve as a means for providing a desired amount of hydraulic pressure 38. In a preferred example the governor 18 is of the type manufactured by the Woodward Governor Company of Rockford, Ill., and provides two functions. The first function is to provide constant hydraulic fluid pressure, which has been set by the boat operator at a desired level. The second function is to control the boat motor speed, to keep the speed at a constant level.

As shown on FIG. 2, the governor 18 provides hydraulic fluid to the propeller 20, to move the piston 30 within the hub 26. Hydraulic fluid 40 delivered by a duct 42 from the governor 18 to the propeller 20. The duct 40 delivers the hydraulic fluid 42 to a stationary adaptor ring 44 that mounts over a first end 46 of the hub 26. The adaptor ring 44 provides a hydraulic fluid delivery plenum 48 to the first end 46 of the hub 18. From this fluid delivery plenum 48 the hydraulic fluid travels through a portion of the hub 18 and into the area between the internal surface 29 of the hub 18 and the piston 30 to provide the pressure to move the piston 30.

In the example illustrated in FIG. 2, the hydraulic fluid 42 is delivered from the plenum 48 through the first end 46 of the hub 26 and into a distribution chamber 50 defined by a gap between the hub 26 and the shaft 22. From this distribution chamber 50, the hydraulic fluid 42 is delivered to the space between the internal surface 29 of the hub 26 and the piston 30 to move the piston 30.

Figures 5, 5A:
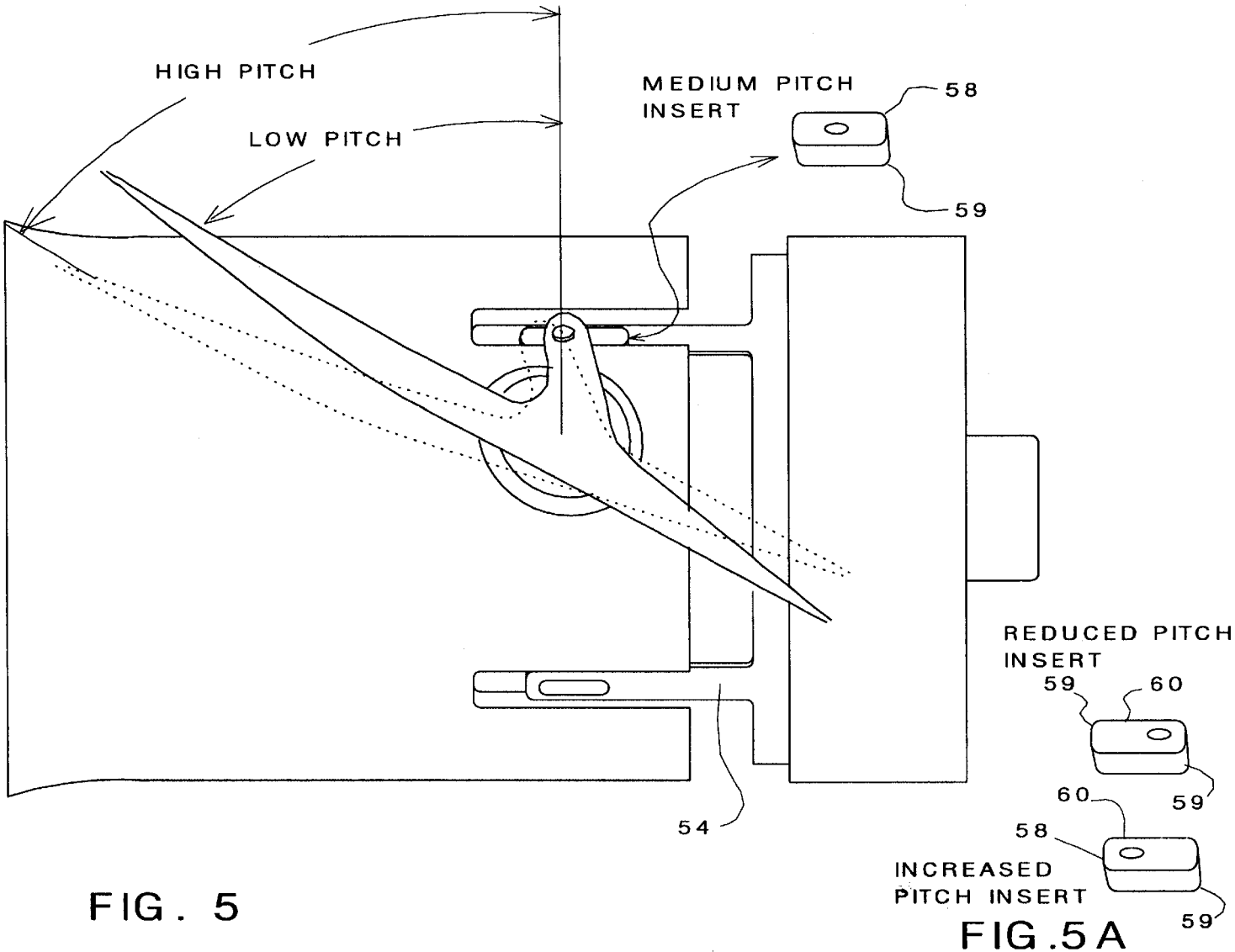
FIG. 5 is a view looking down on one of the blades and the adjustable connection of blade to the annular piston taught herein.
FIG. 5A illustrates inserts used to adjust the starting and maximum pitch of the screw or propeller.

As shown on FIGS. 2 and 5, the piston 30 is connected to the blades 32 through connecting means 34, which in a preferred example of the invention consists of a substantially rigid link 52 with a first end 54 that is connected to, or extends from, the piston 30, and a second end 56 that is pivotally connected to one of the blades 32.

As shown in FIG. 5A, the second end 56 of the link 52 is pivotally connected to one of the blades 32 by way of a removable insert 58. A preferred example of the insert 58, which has been shown on FIG. 5A, includes a symmetrical body 59 and an asymmetrically located connecting joint 60 along the body. The asymmetrical location of the connecting joint 60 on the insert 58 together with the configuration of the body 59, allows the user to vary the length of the connection between the blade 32 and the piston 30 by simply changing the orientation of the insertion of the insert 58. Thus, the positioning of the insert 58 with one orientation produces one length of connection between the blade bade 32 and the piston 30, and one corresponding preset pitch angle between the blade 32 and the hub 26, and the positioning of the insert 58 in another orientation (a 180 degree rotation, for example) provides a different preset pitch angle between the blade 32 and the hub 26.

Figure 3:
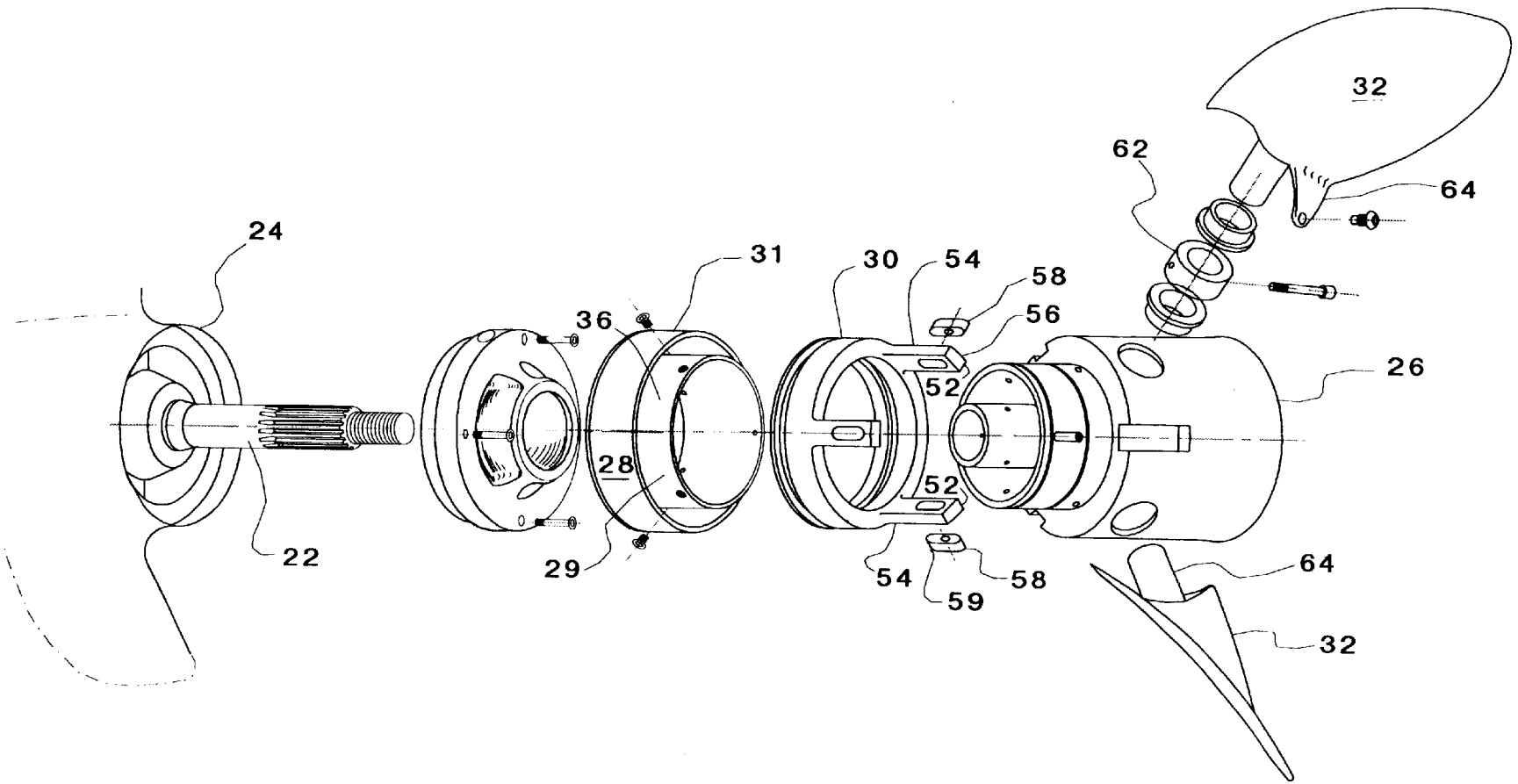
FIG. 3 is an exploded view of a highly preferred example of the disclosed adjustable propeller taught herein.
Figure 4:
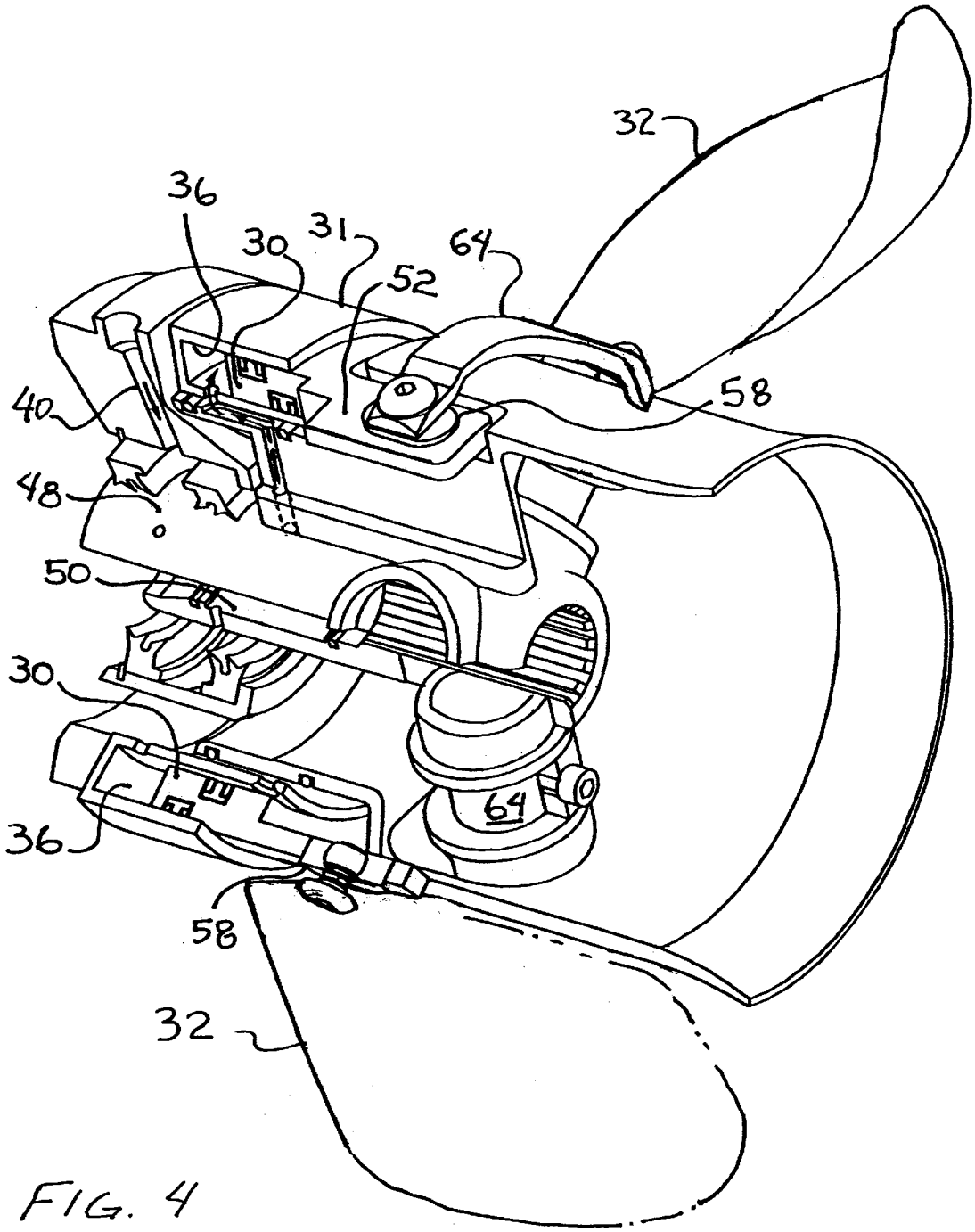
FIG. 4 is a perspective view of the propeller with a section cut away to illustrate the assembly of important components of the disclosed invention.

Turning now to FIGS. 3 and 4, it will be understood that according to a highly preferred embodiment of the invention the piston 30 is of an annular shape. Additionally, the hub 26 that supports the piston 30 is also of an annular shape, and together with its internal surface 29 defines an annular housing 31. This arrangement allows the system to be attached over the drive shaft of a marine drive unit that has been designed for use with a fixed blade propeller. Additionally, it has been discovered that very reliable, balanced actuation of the blades can be achieved by connecting all blades to a single piston. It is believed that the connection and actuation of all of the blades to a single piston eliminates the possibility of uneven or inconsistent blade pitch on the different blades about the propeller due to a variation in pressure from one piston to another. The variation in pressure being caused by differences in routing to the different locations or a clog in the feed hydraulic feed line to one piston of a multi-piston blade adjustment system.

In operation, the blades 32 of the disclosed system will be forced into the lowest pitch position by a reduction or loss of hydraulic pressure. The hydrodynamic pressure imposed on the blades 32 by the moving propeller. Preferably, the blades 32 will be pivotally mounted on the hub 26 on a set of bearings or bushings 62 that allow relatively unrestricted pivoting of the blades 32 at about an axis that is on the same plane as the axis of the drive shaft 22. Each of the blades will preferably include a rigid connecting arm 64 that connects with the second end 56 of the link 52, preferably through the use of a connector such as the insert 58 described above.

The angle between the connecting arm 64 and the link 52 can be adjusted by means of the insert 52 to set the lowest pitch angle of the blade 32. Thus, when initiating the propulsion of the boat 12, the blades 32 will be found at the lowest pitch angle allowed by the geometry of the piston 30, link 52 and connecting arm 64/blade 32 geometry. This low pitch angle will allow the boats engine to develop the needed RPMs to generate the power needed to initiate motion and acceleration of the boat through the water. Once a desired engine speed is achieved, the speed of the boat may be adjusted by adjusting the pitch the blades. The adjustment of the pitch of the blades is carried out by adjusting the pressure of the hydraulic fluid delivered to the piston 30 by way of the governor 18. Conversely stated, by setting the pressure of the hydraulic fluid as delivered or set by the governor 18, the pitch of the blades 32 will change in response to a change in hydrodynamic forces imposed on the blade. Thus if the boat's hull rises from the water, reducing the drag and hydrodynamic forces on the blades 32, the pitch of the blades 32 will automatically increase, taking advantage of the ability to increase the distance traveled per turn of the screw due to the decreased power consumption produced by the reduced drag. Additionally, it is important to note that it is further contemplated that the control unit 16 can be used to provide the signal that sets the governor 18 to provide a desired constant hydraulic pressure between the annular housing, or hub 26, and the annular piston 30 while setting an operating speed of the boat motor.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An adjustable pitch boat propeller system adapted for mounting over a drive shaft of a marine drive unit, the propeller comprising:

a hub, the hub adapted for mounting over the drive shaft of the marine drive unit, the hub having an external surface, an internal annular surface adapted for accepting the drive shaft therethrough and an annular piston housed within said external surface;

a plurality of blades pivotally connected to said external surface of said hub; and a connecting means for pivoting said plurality of blades in response to movements of said piston.

2. A system according to claim 1 and further comprising means for providing a desired amount of hydraulic pressure between the internal surface of said hub and said piston.

3. A system according to claim 2 wherein said means for providing a desired amount of hydraulic pressure comprises a constant speed governor with an adjustable pressure output.

4. A system according to claim 2 wherein said connecting means comprises a substantially rigid link having a first end that is pivotally connected to said piston, and a second end that is pivotally connected to one of said blades.

5. A system according to claim 4 wherein said second end of each link comprises a plurality of independent connectors for attaching the link to one of the blades, so that the location of the connection of the link to the blade is varied by changing the attachment of the blade to the independent connector.

6. A system according to claim 4 wherein said second end of each link includes means for accepting a connector, and a removable connector adapted for engagement with the means for accepting a connector, the removable connector having a plurality of independent connectors for attaching the link to one of the blades, so that the location of the connection of the link to the blade is varied by changing the attachment of the blade to the independent connector.

7. A system according to claim 1 and further comprising a governor for providing a desired constant hydraulic pressure between the hub and the piston, the governor being responsive to a signal used to establish an operating speed of the marine drive unit.

8. An adjustable pitch boat propeller system adapted for mounting over a drive shaft of a marine drive unit of a boat, the propeller comprising:

a hub, the hub adapted for mounting over the drive shaft of the boat, the hub having an external surface and internal annular surface adapted for accepting the drive shaft therethrough;

an annular piston mounted against said internal annular surface;

a plurality of blades pivotally connected to said external surface of said hub; and a connecting means for pivoting said plurality of blades in response to movements of said annular piston.

9. A system according to claim 8 and further comprising means for providing a desired amount of hydraulic pressure between the internal annular surface of said hub and said annular piston.

10. A system according to claim 9 wherein said means for providing a desired amount of hydraulic pressure comprises a constant speed governor with adjustable pressure output.

11. A system according to claim 9 wherein said connecting means comprises a substantially rigid link having a first end that is pivotally connected to said annular piston, and a second end that is pivotally connected to one of said blades.

12. A system according to claim 11 wherein said second end of each link comprises a plurality of independent connectors for attaching the link to one of the blades, so that the location of the connection of the link to the blade is varied by changing the attachment of the blade to the independent connector.

13. A system according to claim 11 wherein said second end of each link includes means for accepting a connector, and a removable connector adapted for engagement with the means for accepting a connector, the removable connector having a plurality of independent connectors for attaching the link to one of the blades, so that the location of the connection of the link to the blade is varied by changing the attachment of the blade to the independent connector.

14. A system according to claim 8 and further comprising a governor for providing a desired constant hydraulic pressure between the hub and the annular piston, the governor providing the desired constant hydraulic pressure in response to a boat engine speed.

15. A system according to claim 14 wherein said annular hub is in fluid communication with said governor.

16. A method adjustable pitch boat propeller adapted for mounting over a drive shaft of a marine drive unit of a boat, the method comprising:

providing a propeller comprising:

a hub, the hub adapted for mounting over the drive shaft of the boat, the hub having an external surface, an internal annular surface adapted for accepting the drive shaft therethrough and an annular piston housed within said external surface, the annular piston also being adapted for accepting the drive shaft therethrough;

a plurality of blades pivotally connected to said external surface of said hub; and a connecting means for pivoting said plurality of blades in response to movements of said piston;

providing a desired amount of hydraulic pressure between the internal annular surface of said hub and said annular piston, so that the pitch is adjusted by moving the annular piston within the annular hub by varying the hydraulic pressure between the annular hub and the annular piston.

17. A method according to claim 16 wherein said means for providing a desired amount of hydraulic pressure comprises a constant speed governor with an adjustable pressure output.

18. A method according to claim 16 wherein said connecting means comprises a substantially rigid link having a first end that is pivotally connected to said annular piston, and a second end that is pivotally connected to one of said blades.

19. A method according to claim 18 wherein said second end of each link comprises a plurality of independent connectors for attaching the link to one of the blades, so that the location of the connection of the link to the blade is varied by changing the attachment of the blade to the independent connector.

20. A method according to claim 18 wherein said second end of each link includes means for accepting a connector, and a removable connector adapted for engagement with the means for accepting a connector, the removable connector having a plurality of independent connectors for attaching the link to one of the blades, so that the location of the connection of the link to the blade is varied by changing the attachment of the blade to the independent connector.

* * * * *